US007153188B1

(12) United States Patent
Zuniga et al.

(10) Patent No.: US 7,153,188 B1
(45) Date of Patent: Dec. 26, 2006

(54) TEMPERATURE CONTROL IN A CHEMICAL MECHANICAL POLISHING SYSTEM

(75) Inventors: Steven M. Zuniga, Soquel, CA (US); Hung Chih Chen, Sunnyvale, CA (US); Stan D. Tsai, Fremont, CA (US); Kapila Wijekoon, Palo Alto, CA (US); Fred C. Redeker, Fremont, CA (US); Rajeev Bajaj, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/245,558

(22) Filed: Oct. 7, 2005

(51) Int. Cl.
*B24B 49/00* (2006.01)

(52) U.S. Cl. ..... 451/7; 451/53; 451/286; 451/398

(58) Field of Classification Search ..... 451/7, 451/53, 41, 285–289, 388, 397, 398
See application file for complete search history.

(56) References Cited

U.S. PATENT DOCUMENTS 5,605,488 A 2/1997 Ohashi et al.
5,980,363 A * 11/1999 Meikle et al. ..... 451/41
6,488,571 B1 * 12/2002 Sharan ..... 451/53
6,638,141 B1 * 10/2003 Ide ..... 451/7
6,726,529 B1 * 4/2004 Marcyk et al. ..... 451/7
6,736,720 B1 5/2004 Bright et al.
6,749,484 B1 * 6/2004 Yang et al. ..... 451/7

OTHER PUBLICATIONS

Peggy Cobb, *Silicone-rubber heaters stretch product utility*, Machine Design, Sep. 24, 1998, at 166.

* cited by examiner

*Primary Examiner*—Dung Van Nguyen
(74) *Attorney, Agent, or Firm*—Fish & Richardson

(57) ABSTRACT

The carrier head has a base and a substrate backing structure for holding a substrate against a polishing surface during polishing. The substrate backing structure is connected to the base and includes an external surface that contacts a backside of the substrate during polishing. The substrate backing structure also includes a resistive heating system to distribute heat over an area of the external surface and at least one thermally conductive membrane. The external surface is a first surface of the at least one thermally conductive membrane, and the resistive heating system is integrated within one of the at least one thermally conductive membrane.

27 Claims, 4 Drawing Sheets

TEMPERATURE CONTROL IN A CHEMICAL MECHANICAL POLISHING SYSTEM

BACKGROUND

The present invention relates to a chemical mechanical polishing carrier head that includes a resistive heating system, and associated methods.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the exposed surface of the substrate becomes increasingly nonplanar. This nonplanar surface presents problems in the photolithographic steps of the integrated circuit fabrication process. Therefore, there is a need to periodically planarize the substrate surface.

One accepted method of planarization is chemical mechanical polishing (CMP). This planarization method typically requires that the substrate be mounted on a carrier or polishing head. The exposed surface of the substrate is placed against a moving polishing surface, such as a rotating polishing pad. The polishing pad can be a "standard" polishing pad with a durable roughened surface or a "fixed-abrasive" polishing pad with abrasive particles held in a containment media. The carrier head provides a controllable load to the substrate to push it against the polishing pad. A polishing slurry, which can include abrasive particles, is supplied to the surface of the polishing pad.

The polishing rate in a chemical-mechanical process depends on a variety of factors, including the pressure between the substrate and the polishing pad and the temperature at the polishing surface. Consequently, differences in pressure or temperature across the surface of the substrate during polishing can cause the polishing rate to vary from one section of the substrate surface to another.

SUMMARY

In one aspect, the invention is directed to a carrier head for a chemical mechanical polishing system. The carrier head has a base and a substrate backing structure for holding a substrate against a polishing surface during polishing. The substrate backing structure is connected to the base and includes an external surface that contacts a backside of the substrate during polishing. The substrate backing structure also includes a resistive heating system to distribute heat over an area of the external surface and at least one thermally conductive membrane. The external surface is a first surface of the at least one thermally conductive membrane, and the resistive heating system is integrated within one of the at least one thermally conductive membrane.

Implementations of the invention may include one or more of the following features. The resistive heating system may be operable to provide more heat to a first section of the external surface than to a second section of the external surface. The resistive heating system may include a first heating element proximal to the first section of the external surface and a second heating element proximal to the second section of the external surface. The first and second heating elements may be independently controllable. The first and second heating elements may be configured to generate different amounts of heat, e.g., the first and second heating elements may have different densities of resistive elements. The external surface may be a surface of and the resistive heating system may be integrated within the same thermally conductive membrane. A chamber may be located between the thermally conductive membrane and the base. The at least one thermally conductive membrane may include a plurality of thermally conductive membranes, the first surface may be a surface of a first membrane, and the resistive heating system may be integrated within a different second membrane. The second membrane may be positioned between the base and the first membrane. There may be a first chamber between the first membrane and the second membrane and a second chamber between the second membrane and the base. A contact area between the second membrane and the first membrane may be controllable.

In another aspect, the invention is directed to a method of polishing. The method includes positioning a substrate on an external surface of at least one thermally conductive membrane of a substrate backing structure of a carrier head, loading the substrate against a polishing surface, creating relative motion between the substrate and the polishing surface, and heating the substrate with a resistive heating system. The resistive heading system distributes heat over an area of the external surface and is integrated within the at least one thermally conductive membrane.

Implementations of the invention may include one or more of the following features. More heat can be provided to a first section of the external surface than to a second section of the external surface. A first heating element proximal to the first section of the external surface and a second heating element proximal to the second section of the external surface can be independently controlled. A first heating element proximal to the first section of the external surface and a second heating element proximal to the second section of the external surface can be commonly controlled, and the first and second heating elements can be configured to generate different amounts of heat. The external surface may be a surface of and the resistive heating system may be integrated within the same thermally conductive membrane. The at least one thermally conductive membrane may include a plurality of thermally conductive membranes, the first surface may be a surface of a first membrane, and the resistive heating system may be integrated within a different second membrane. A pressure may be applied the substrate with a chamber located between the base and the at least one membrane.

Potential advantages of implementations of the invention include one or more of the following. The resistive heating system that is embedded in the thermally conductive membrane can efficiently transfer heat to the substrate. The resistive heating system embedded in the thermally conductive membrane or the internal membrane can reduce the number of components in a carrier head compared to separately introducing heaters to the carrier head. The resistive heating system can control the temperature distribution over the surface of the wafer being polished and thus control the rate of polishing over different sections of the external surface. The temperature distribution can be used to balance the polishing rate in a polishing apparatus that would otherwise polish different sections of the substrate unevenly. The temperature distribution can also improve planarization of the thickness of a substrate, which has greater thickness in certain sections due to an uneven deposition process. The temperature distribution can also be used to polish a substrate to another desired thickness profile, for example, to prepare it for further polishing on an apparatus with known defects. Heating the membrane that is in contact with the substrate can soften the membrane, thus causing it to contact the substrate more uniformly. In addition, a resistive heating system can require less maintenance and provide heat more quickly than a convective heating system.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

As noted above, in a chemical mechanical polishing (CMP) system, a substrate to be polished can be mounted on a carrier head. In addition, the polishing rate can be affected by the pressure between the substrate and the polishing pad and the temperature at the polishing surface.

Figure 1:
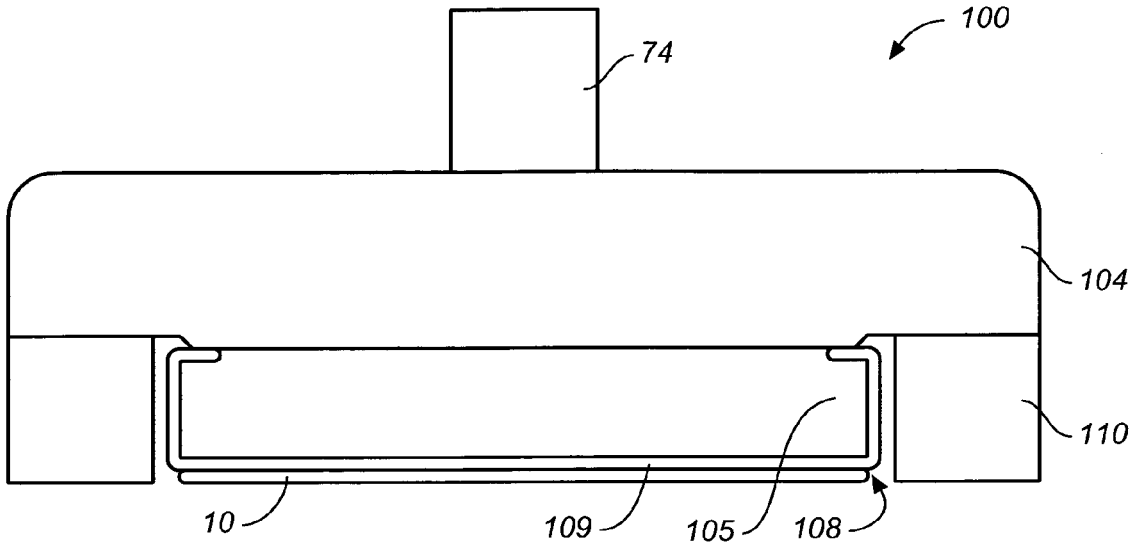
FIG. 1 shows a cross-sectional view of a carrier head, which includes an external membrane for pressing a substrate against a polishing pad.

In FIG. 1, a carrier head 100 is included in a CMP system which can polish one or more substrates 10. A description of a suitable CMP apparatus can be found in U.S. Pat. No. 5,738,574, the entire disclosure of which is incorporated herein by reference.

A heating system in carrier head 100 can affect the temperature distribution across the surface of substrate 10, thereby controlling the polishing rate at different regions on the surface, as will be described in greater detail below. By controlling the temperature distribution, carrier head 100 can compensate, for example, for otherwise uneven polishing by the CMP apparatus, for non-uniformity in the initial thickness of the substrate, or for non-uniformity inherent in the polishing process.

The carrier head 100 includes a base assembly 104, a retaining ring 110, and a substrate backing assembly 108. The base assembly 104 can be connected directly or indirectly to a rotatable drive shaft 74. Substrate backing assembly 108 can include an external membrane 109 and a chamber between external membrane 109 and base assembly 104. Although not illustrated, substrate backing assembly 108 can include one or more flexible membranes in the substrate backing assembly 10, one or more pressurizable chambers to apply pressure to the flexible membranes, or one or more pumps to apply pressure to the chambers. The substrate backing assembly can be constructed, by way of example, as described in U.S. Pat. No. 6,450,868, or in or in U.S. patent application Ser. No. 10/810,784, filed Mar. 26, 2004, the entire disclosures of which are incorporated herein by reference.

The carrier head can include other elements, also unillustrated, such as a housing that is securable to the drive shaft and from which base 104 is movably suspended, a gimbal mechanism (which can be considered part of the base assembly) that permits base 104 to pivot, and a loading chamber between base 104 and the housing. The carrier head 100 can be constructed, by way of example, as described in U.S. Pat. No. 6,183,354, or in U.S. patent application Ser. No. 09/470,820, filed Dec. 23, 1999, or in U.S. patent application Ser. No. 09/712,389, filed Nov. 13, 2000, the entire disclosures of which are incorporated herein by reference.

The carrier heads in the following embodiments include resistive heating systems which heat the surface of the substrate backing portion in contact with the substrate. The heating systems can vary the relative polishing rates at different sections of the substrate surface by varying the temperature distribution on the surface. The variation in temperature along the surface can be used, for example, to compensate for otherwise uneven polishing rates by the CMP apparatus or to even out a substrate that has uneven thickness.

Figure 2A:
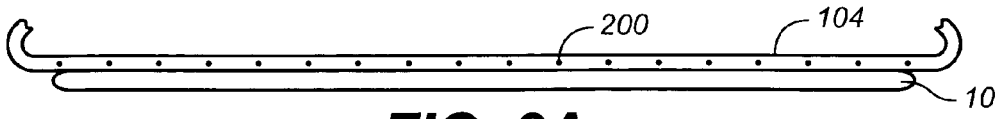
FIGS. 2A–2G show more detailed cross-sectional views of seven embodiments of the heating systems providing heat to the external membrane of FIG. 1.

FIG. 2A shows an embodiment of the present invention including thermally conductive external membrane 109 with integrated heating elements 200. The heating elements are, for example, electrical resistive heating elements, e.g., wires, powered by an electrical source (not shown) through a set of conductors (also not shown) connecting the heating elements to the power source. The resistive heating elements can extend through the membrane in a variety of patterns, such as a spiral, cross-latch, parallel lines, radial segments or concentric circles. The conductors can be connected to the power source through a commutator. The heating elements generate heat and external membrane 109 conducts the heat to the surface of substrate 10, which is in contact with external membrane 109. The heat raises the temperature of the substrate, thereby typically increasing the rate of polishing. Each heating element 200 can be controlled to generate varying amounts of heat so that different temperatures are generated in different parts of the substrate 100.

Figure 2B:
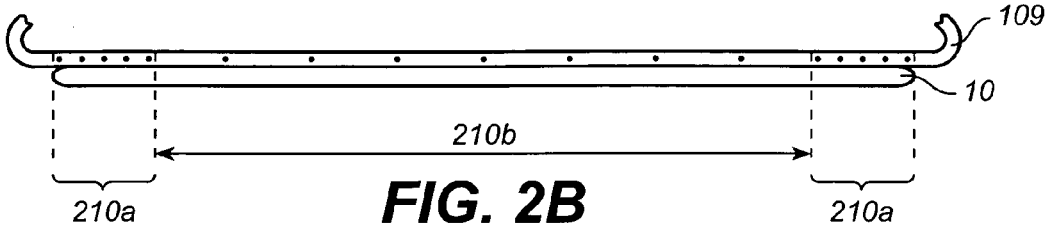

The external membrane 109 can contain a varying density of heating elements as shown in FIG. 2B. For example, the density of the heating elements can be lower in an inner circular region 210*b* than in an outer annular region 210*a*. During polishing, the higher density of heating elements in outer region 210*a* results in higher temperatures in portions of substrate 10 that are in contact with region 210*a* than in the inner portions of substrate 10. More of the substrate is removed in the outer portions where the substrate is at a higher temperature, because the polishing rate is generally proportional to the processing temperature. This distribution of heating elements can be used in polishing systems that would otherwise have a faster polishing rate towards the center of the substrate than towards outer portions of the substrate. The distribution can also be used to polish substrates that have a higher initial thickness in the annular region 210*a*.

A different distribution of heating elements can be chosen to balance the polishing rate or to produce a wafer with uniform thickness or to achieve a target thickness profile. For example, to remove more of the substrate in the inner region 210*b* than in the outer region 210*a*, a membrane with a higher distribution of heating elements in the inner region would be used. Such membrane can be used in polishing systems where the polishing rate would otherwise be lower in the inner portions of the substrate.

Figure 2C:
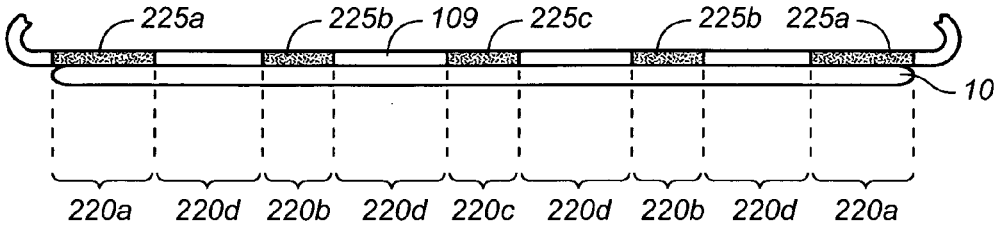

Alternatively, external membrane 109 can alternatively have a plurality of annular heating elements, as shown in FIG. 2C. For example, the external membrane 109 can be formed from silicon rubber that has annular heating elements 225*a* and 225*b*, and circular heating element 225*c* integrated into it. A controller (not shown) separately controls the amount of electrical power delivered by the electrical source to each of the heating elements 225*a–c*, thereby independently controlling the temperature of each of the portions 220*a–c* of the substrate 10 that are respectively proximal to the heating elements 225*a–c*. the temperature in portion 220*d* is controlled by the two adjacent heaters. By providing more electrical power to certain heating elements, for example, 225*b* and 225*c* in FIG. 2C, the portions 220*b* and 220*c* of the substrate 10 that are proximal to the heating elements can be polished faster than other portions 220*a* and 220*b* of the substrate. Such a system can be used, for example, to achieve a uniform polishing rate over the surface of the substrate.

A substrate backing assembly 108 in a carrier head providing heat from a resistive heating system to the substrate can also be accomplished by various other embodiments. For example, in the embodiment in FIG. 2D, the substrate backing assembly 108 contains an internal membrane, 230, with heating elements 200 integrated into it. The heat from heating elements 200 is conducted through internal membrane 230 to external membrane 109, which then conducts the heat to substrate 10. Internal membrane 230 can be a flexible membrane so that heat from heating elements 200 is only conducted to those portions of the external membrane in contact with internal membrane 230, i.e., contact area 235. As previously described, the carrier head can contain various pumps to control the shape of the internal membrane 230, and thereby control the size of the contact area 235. In this embodiment, the polishing rate in the contact area 235 is increased by the higher temperature due to the heat from the internal membrane 230. The polishing rate in the contact area 235 can also be increased due to the higher pressure from internal membrane 230 on the external membrane 109.

Figure 2D:
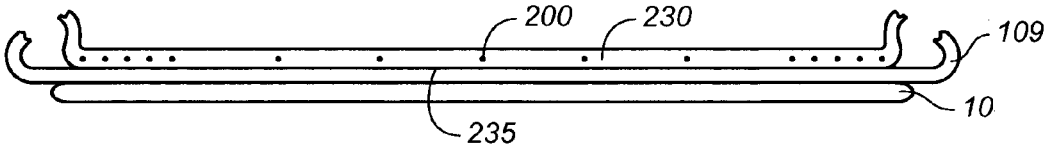
Figure 2E:
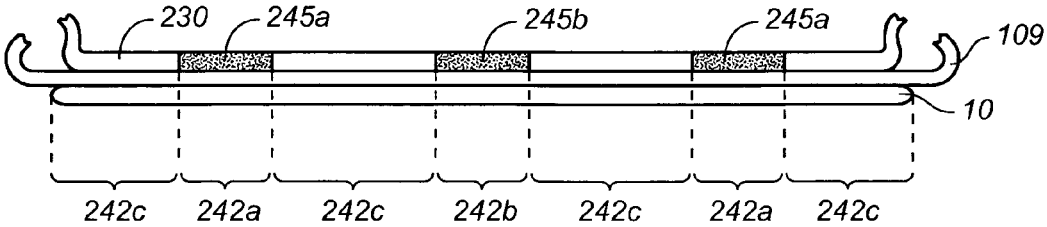

Similarly, in FIG. 2E, an internal membrane 230 has annular heating element 245*a* and circular heating element 245*b*, as previously described. Thus, different temperatures can be generated in the regions 242*a–c*, conducted to exterior membrane 109, and result in different polishing rates in substrate 10.

Figure 2F:
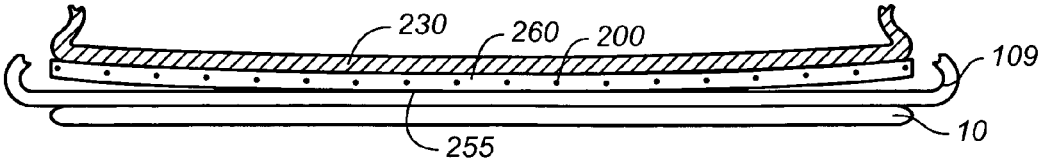

Referring to FIG. 2F, an embodiment of the invention can have a heating membrane 260 between the internal membrane 230 and the external membrane 109. Heating membrane 260 has heating elements 200 integrated into it. Heating elements 200 can be uniformly or non-uniformly distributed in heating membrane 260. A heating membrane 260 can contain annular heating elements as previously described. The movement of internal membrane 230 can provide pressure to a contact area 255 between the heating membrane 260 and external membrane 109. Thus, more heat from heating elements 200 will be conducted through external membrane 109 to substrate 10 within the vicinity of contact area 255. The polishing rate in this embodiment in contact area 255 is affected by the higher temperature due to the heat from the heating membrane 260. In addition, the polishing rate can be affected by the higher pressure from the internal membrane 230.

Figure 2G:
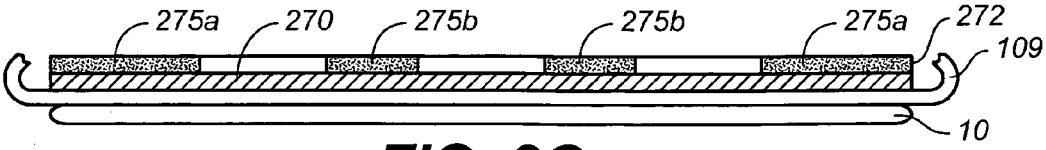

Referring to FIG. 2G, an embodiment of the invention can include a heating membrane 272, which is bonded to the external membrane 109 using a bonding layer 270. Heating membrane 272 can be a flexible membrane formed from conductive silicon rubber, and bonded to external membrane 109 by a bonding layer 270 of room temperature vulcanizing rubber ("RTV"). Heating elements in heating membrane 272 can be annular heating elements 275*a* and 275*b* as shown in FIG. 2G, or can be resistive elements as shown in FIG. 2A. Heating elements 275*a–b* generate heat and external membrane 109 conducts the heat to the surface of the substrate 10, which is in contact with external membrane 109.

The described heated membranes can be obtained from Watlow Electrical Manufacturing Company of St. Louis, Mo.

The desired distribution of heating elements, can be determined empirically by studying the profiles of polished surfaces and placing the heating elements to achieve a desired profile. More specifically, the heating elements are distributed to provide higher temperatures to sections of the substrate that need to be polished more. In the embodiments of FIGS. 2B and 2D, this is done by increasing the density of heating elements and/or providing more power in sections that need more polishing. With the heating elements in FIGS. 2C, 2E, and 2G, this is done by controlling electrical power provided to the heating elements in addition to the placement of the heating elements. Other substrates are then polished using a carrier head that includes the heating element. The surfaces of the polished substrates are studied, and the process can be repeated until the carrier head polishes the substrates uniformly.

Figure 3:
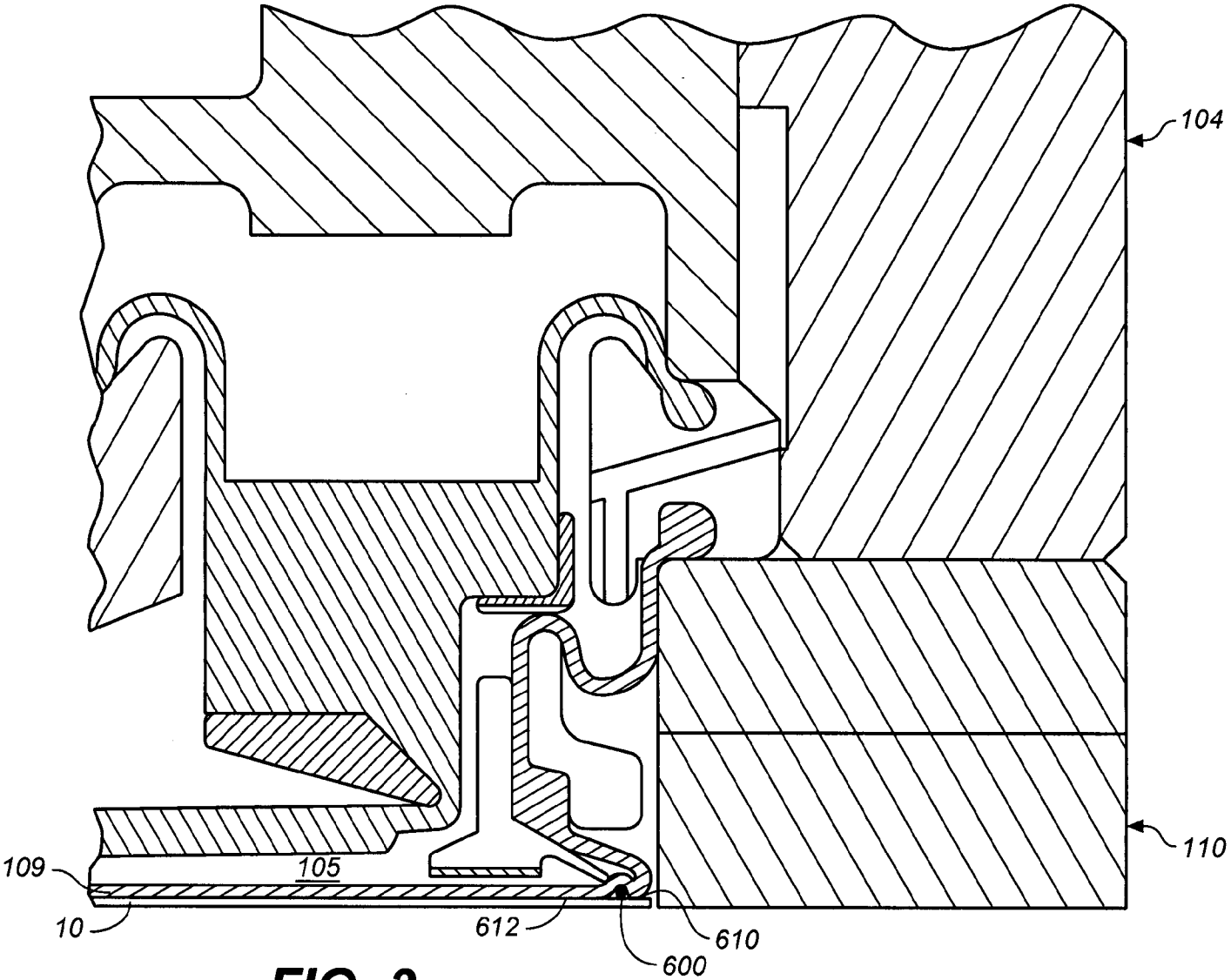
FIG. 3 shows a close up of a membrane contacting a substrate with debris trapped between the membrane and the substrate.

The embedded heating elements can also serve another purpose. Referring to FIG. 3, external membrane 109 can be heated, for example before polishing begins, as described in any one of the embodiments above to soften membrane 109 and cause the membrane to exert pressure on substrate 10 more uniformly. This has a variety of advantages. For instance, when a particle of debris 600 is trapped between external membrane 109 and substrate 10, the heat can be used to soften external membrane 109 causing it to conform around debris 600 and contact the substrate more uniformly so as to more evenly distribute the pressure on the substrate. After heating the membrane to make it better conform to the backside of the substrate, it will retain its shape even after the heat is removed.

Figure 4:
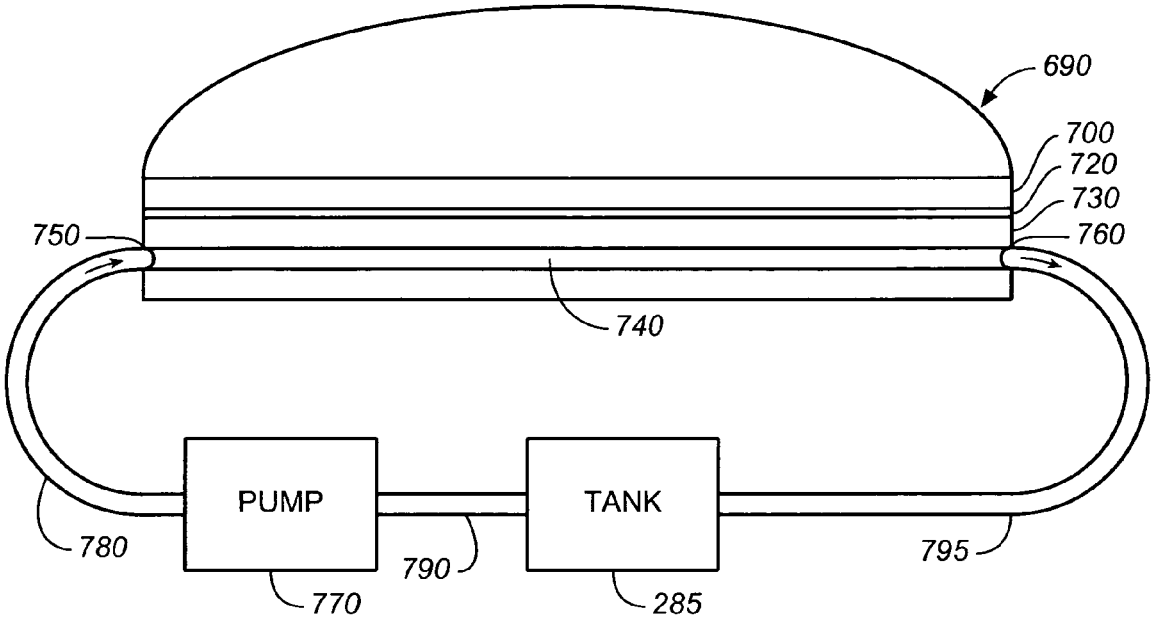
FIG. 4 shows a cross-sectional view of a polishing station of FIG. 1 showing a polishing platen that is cooled using a fluid.
Figure 5:
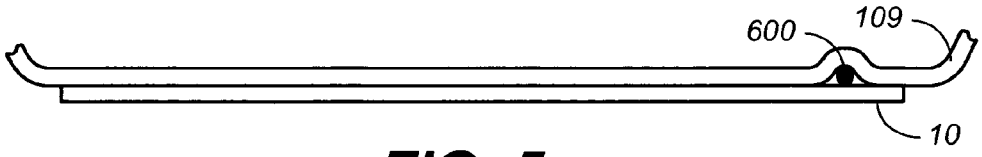

The heated membranes of the embodiments described above can be used with a cooled polishing station to control the average temperature over the polishing surface. Referring to FIG. 4, a representative cooled polishing station 690 includes a polishing pad 700 that is mounted on a polishing platen 730 using a layer 720 of pressure sensitive adhesive. The polishing platen has tubes 740 (only one is shown in the cut-away of FIG. 5) running through it. A pump 770 is connected to an intake end 750 of the tubes by piping 780. A second piping 790 connects the pump to a holding tank 785, which stores a fluid, for example, water. A third piping 795 connects the holding tank 785 to an outtake end 750 of the tubes. During polishing, the pump 770 draws fluid from the tank 780 through piping 790 and forces it into the tubes 740. The fluid flows through the tubes 740 and back into the tank 780 through piping 795.

During polishing heat from the substrate 10 is conducted through the pad 700, the pressure sensitive adhesive layer 720, the platen 730, and into the fluid in the tubes 740. The fluid carries the heat out of the platen as it flows out into piping 795, thereby cooling the substrate. By controlling a rate at which the pump 770 forces fluid through the tube, the pump can be used to control the average temperature of the substrate. The previously described heating systems can concurrently be used to control the temperature of one section of the substrate relative to another section of the substrate.

A number of embodiments of the invention have been described. Nevertheless, it will be understood that various modifications can be made without departing from the spirit and scope of the invention. For example, the temperature control can be applied to different types of carrier heads. The embodiments that are described above are merely an illustration of the possibilities. For example, the carrier head can be a simple design with one or more internal pressure chambers; it can have one or more membranes; or it can have a surface for contacting the backside of the substrate that is not in the form of a membrane but is simply a rigid flat material. Accordingly, other embodiments are within the scope of the following claims.

What is claimed is:

1. A carrier head for a chemical mechanical polishing system, the carrier head comprising:

a base; and a substrate backing structure for holding a substrate against a polishing surface during polishing, the substrate backing structure being connected to the base, the substrate backing structure including an external surface that contacts a backside of the substrate during polishing, the substrate backing structure including a resistive heating system to distribute heat over an area of the external surface and at least one thermally conductive membrane;

wherein the external surface comprises a first surface of the at least one thermally conductive membrane, and the resistive heating system is integrated within one of the at least one thermally conductive membrane.

2. The carrier head of claim 1, wherein the resistive heating system is operable to providing more heat to a first section of the external surface than to a second section of the external surface.

3. The carrier head of claim 2, wherein the resistive heating system includes a first heating element proximal to the first section of the external surface and a second heating element proximal to the second section of the external surface.

4. The carrier head of claim 3, wherein the first and second heating elements are independently controllable.

5. The carrier head of claim 3, wherein the first and second heating elements are configured to generate different amounts of heat.

6. The carrier head of claim 5, wherein the first and second heating elements have different densities of resistive elements.

7. The carrier head of claim 1, wherein the external surface comprises a surface of and the resistive heating system is integrated within the same thermally conductive membrane.

8. The carrier head of claim 7, further comprising a chamber between the thermally conductive membrane and the base.

9. A carrier head for a chemical mechanical polishing system, the carrier head comprising:

a base; and a substrate backing structure for holding a substrate against a polishing surface during polishing, the substrate backing structure being connected to the base, the substrate backing structure including an external surface that contacts a backside of the substrate during polishing, the substrate backing structure including a resistive heating system to distribute heat over an area of the external surface and at least one thermally conductive membrane;

wherein the external surface comprises a first surface of the at least one thermally conductive membrane, and the resistive heating system is integrated within one of the at least one thermally conductive membrane;

wherein the at least one thermally conductive membrane comprises a plurality of thermally conductive membranes, the first surface is a surface of a first membrane, and the resistive heating system is integrated within a different second membrane.

10. The carrier head of claim 9, wherein the second membrane is positioned between the base and the first membrane.

11. The carrier head of claim 10, further comprising a first chamber between the first membrane and the second membrane and a second chamber between the second membrane and the base.

12. The carrier head of claim 10, wherein a contact area between the second membrane and the first membrane is controllable.

13. A method of polishing, comprising:

positioning a substrate on an external surface of at least one thermally conductive membrane of a substrate backing structure of a carrier head;

loading the substrate against a polishing surface;

creating relative motion between the substrate and the polishing surface; and heating the substrate with a resistive heating system, the resistive heading system distributing heat over an area of the external surface and integrated within the at least one thermally conductive membrane.

14. The method of claim 13, further comprising providing more heat to a first section of the external surface than to a second section of the external surface.

15. The method of claim 14, further comprising independently controlling a first heating element proximal to the first section of the external surface and a second heating element proximal to the second section of the external surface.

16. The method of claim 13, further comprising commonly controlling a first heating element proximal to the first section of the external surface and a second heating element proximal to the second section of the external surface, wherein the first and second heating elements are configured to generate different amounts of heat.

17. The method of claim 13, wherein the external surface comprises a surface of and the resistive heating system is integrated within the same thermally conductive membrane.

18. The method of claim 13, further comprising applying a pressure to the substrate with a chamber located between the base and the at least one membrane.

19. A method of polishing, comprising:

positioning a substrate on an external surface of at least one thermally conductive membrane of a substrate backing structure of a carrier head;

loading the substrate against a polishing surface;

creating relative motion between the substrate and the polishing surface; and heating the substrate with a resistive heating system, the resistive heading system distributing heat over an area of the external surface and integrated within the at least one thermally conductive membrane, wherein the at least one thermally conductive membrane comprises a plurality of thermally conductive membranes, the first surface is a surface of a first membrane, and the resistive heating system is integrated within a different second membrane.

20. A carrier head for a chemical mechanical polishing system, the carrier head comprising:

a base; and a substrate backing structure for holding a substrate against a polishing surface during polishing, the substrate backing structure being connected to the base, the substrate backing structure including an external surface that contacts a backside of the substrate during polishing, the substrate backing structure including a resistive heating system to distribute heat over an area of the external surface and at least one thermally conductive membrane, wherein the external surface comprises a first surface of the at least one thermally conductive membrane, and the resistive heating system is integrated within one of the at least one thermally conductive membrane, wherein the resistive heating system includes a first heating element proximal to a first section of the external surface and a second heating element proximal to a second section of the external surface, and is operable to provide more heat to the first section of the external surface than to the second section of the external surface, and wherein the first and second heating elements are configured to generate different amount of heat by having different densities of resistive elements.

21. The carrier head of claim 20, wherein the first and second heating elements are independently controllable.

22. The carrier head of claim 20, wherein the external surface comprises a surface of and the resistive heating system is integrated within the same thermally conductive membrane.

23. The carrier head of claim 20, wherein the at least one thermally conductive membrane comprises a plurality of thermally conductive membranes, the first surface is a surface of a first membrane, and the resistive heating system is integrated within a different second membrane.

24. A method of polishing, comprising:

positioning a substrate on an external surface of at least one thermally conductive membrane of a substrate backing structure of a carrier head;

loading the substrate against a polishing surface;

creating relative motion between the substrate and the polishing surface;

heating the substrate with a resistive heating system, the resistive heading system distributing heat over an area of the external surface and integrated within the at least one thermally conductive membrane; and controlling a first heating element proximal to the first section of the external surface and a second heating element proximal to the second section of the external surface, wherein the first and second heating elements are operable to generate different amounts of heat by having different densities of resistive elements.

25. The method of claim 24, further comprising independently controlling the first and second heating elements.

26. The method of claim 24, wherein the external surface comprises a surface of and the resistive heating system is integrated within the same thermally conductive membrane.

27. The method of claim 24, wherein the at least one thermally conductive membrane comprises a plurality of thermally conductive membranes, the first surface is a surface of a first membrane, and the resistive heating system is integrated within a different second membrane.

* * * * *